US007023294B2

(12) United States Patent
Hauger et al.

(10) Patent No.: US 7,023,294 B2
(45) Date of Patent: Apr. 4, 2006

(54) SYSTEM AND A METHOD FOR REDUCING TILT EFFECTS IN A RADIO FREQUENCY ATTENUATOR

(75) Inventors: Michael E. Hauger, Pennsauken, NJ (US); William T. Homiller, Perkiomenville, PA (US)

(73) Assignee: General Instrument Corporation, Horsham, PA (US)

( * ) Notice: Subject to any disclaimer, the term of this patent is extended or adjusted under 35 U.S.C. 154(b) by 95 days.

(21) Appl. No.: 10/758,937

(22) Filed: Jan. 15, 2004

(65) Prior Publication Data

US 2005/0156685 A1 Jul. 21, 2005

(51) Int. Cl.
*H01P 1/22* (2006.01)

(52) U.S. Cl. ..... 333/81 R

(58) Field of Classification Search ..... 333/81 R, 333/81 A, 262; 327/308
See application file for complete search history.

(56) References Cited

U.S. PATENT DOCUMENTS

| | | | | |
|---|---|---|---|---|
| 4,236,126 | A | 11/1980 | Weller et al. | 333/81 R |
| 4,736,166 | A | 4/1988 | Eckland et al. | 330/284 |
| 5,233,317 | A * | 8/1993 | Snodgrass et al. | 333/81 A |
| 5,521,560 | A * | 5/1996 | Burns et al. | 333/81 A |

FOREIGN PATENT DOCUMENTS

JP 06152301 A * 5/1994

* cited by examiner

*Primary Examiner*—Stephen E. Jones
(74) *Attorney, Agent, or Firm*—Lawrence T. Cullen

(57) ABSTRACT

A system for reducing tilt effects in a radio frequency (RF) attenuator includes an RF attenuator having at least one series diode, and at least one shunt branch including at least one shunt diode, the shunt branch being electrically coupled to the series diode, and a parallel resonant circuit electrically coupled to each of the at least one shunt branch, wherein the parallel resonant circuit is configured to compensate for a parasitic reactance in the RF attenuator.

20 Claims, 3 Drawing Sheets

300

SYSTEM AND A METHOD FOR REDUCING TILT EFFECTS IN A RADIO FREQUENCY ATTENUATOR

FIELD

The present system and method relate to signal attenuation. More particularly, the present system and method provide for reducing the difference in signal amplitude that occurs in an attenuator over various frequency ranges.

BACKGROUND

Radio receivers accept and process radio frequency (RF) transmitted energy signals to yield, generally, audible or visual information. Typically, the originally received RF signal will be converted to an intermediate frequency (IF) signal prior to reducing the desired signal information yet further to audio levels. Various signal processing functions may occur at the IF level, including signal attenuation as may be necessary to prevent the signal from exceeding a threshold level. Additionally, attenuation may be performed on a received signal to cancel a number of distortion products gained during transmission.

FIG. 1 illustrates a constant impedance attenuator circuit (100) according to the prior art. Traditional constant impedance attenuator circuits are usually based on a classic PI or T circuit. The PI circuit illustrated in FIG. 1 may be selected as it can have better high frequency, wide bandwidth behavior when compared to a T circuit. As shown in FIG. 1, a constant impedance attenuator (100) may include a signal input (110) and a signal output (120). Additionally, a series resistive element (130) and a pair of shunt resistive elements (140, 150) may be coupled to the circuit as illustrated in FIG. 1. For an attenuator with equal input and output impedances, the shunt elements (140, 150) have equal values. The absolute impedance values and the ratio of the shunt and series values determine the impedance and the attenuation value imposed onto received RF signals.

While the constant impedance fixed attenuator circuit (100) illustrated in FIG. 1 is effective for input signals having a constant level, this is often not the case with a received signal. Rather, received signals and their uses often require variable attenuation levels and tight tilt specifications.

SUMMARY

A system for reducing tilt effects in a radio frequency (RF) attenuator includes an RF attenuator having at least one series diode, and at least one shunt branch including at least one shunt diode, the shunt branch being electrically coupled to the series diode, and a parallel resonant circuit electrically coupled to each of the at least one shunt branch, wherein the parallel resonant circuit is configured to compensate for a parasitic reactance in the RF attenuator.

BRIEF DESCRIPTION OF THE DRAWINGS

The accompanying drawings illustrate various embodiments of the present system and method and are a part of the specification. Together with the following description, the drawings demonstrate and explain the principles of the present method and system. The illustrated embodiments are examples of the present system and method and do not limit the scope thereof.

Throughout the drawings, identical reference numbers designate similar but not necessarily identical elements.

DETAILED DESCRIPTION

The present specification describes a method and a system for providing tilt correction in a 6-diode PIN attenuator. More specifically, a parallel resonant circuit including an inductor, a capacitor, and a resistor coupled in parallel are added to each of the shunt legs of the 6-diode PIN attenuator. The added circuits exhibit high impedance at high signal frequencies and progressively lower impedance as frequency decreases, thereby canceling the effect of unwanted parasitic reactances that may exist in the 6-diode PIN attenuator. The structure and operation of the parallel resonant circuit will be described in further detail below.

In the present specification and in the appended claims, the term "attenuator" is meant to be understood broadly as referring to any circuit in a broadband RF system configured to decrease the sensitivity, measured in decibels, of the system. According to one exemplary embodiment, attenuators may be used in situations where a desired signal is too strong to be effectively processed.

Moreover, the term "PIN diode" or "positive-intrinsic-negative diode" refers to a diode with a large intrinsic (I) region sandwiched between a P- and an N-doped semiconducting regions. PIN diodes appear as an almost pure resistance at RF. The value of this resistance can be varied over a range of approximately 1 to 10,000 ohms by direct current control.

Additionally, the term "tilt" refers to a difference in signal amplitude between the highest and lowest system frequencies. Similarly, the term "down tilt" refers to an un-intentional increase in attenuation in a 6-diode PIN attenuator that corresponds with an increase in frequency. A down tilt may be caused by any number of parasitic reactances occurring in the 6-diode PIN attenuator that increase with increased frequency.

In the following description, for purposes of explanation, numerous specific details are set forth in order to provide a thorough understanding of the present system and method for providing tilt correction to a 6-diode PIN attenuator. It will be apparent, however, to one skilled in the art that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Overall Structure

Figure 1:
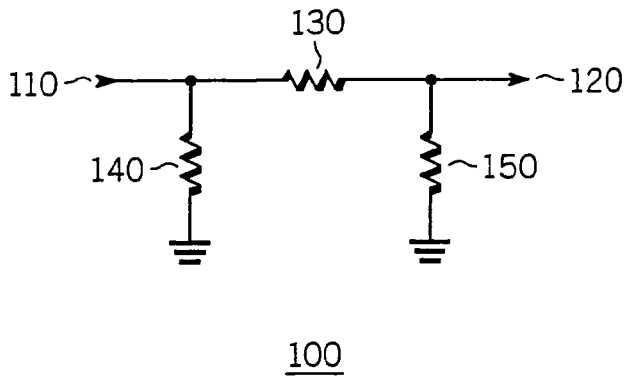
FIG. 1 (Prior Art)
FIG. 1 is a simple circuit diagram illustrating a prior art fixed attenuation, constant impedance attenuator circuit according to one exemplary embodiment.
Figure 2:
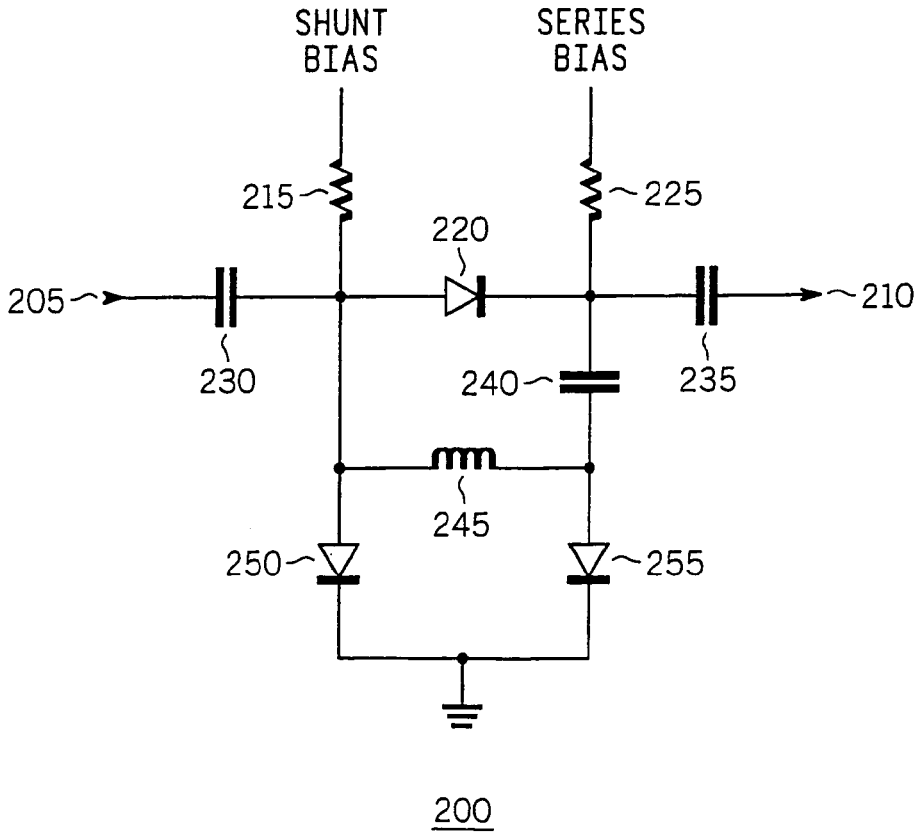
FIG. 2 is a simple circuit diagram illustrating a variable attenuation, constant impedance attenuator circuit including PIN diodes according to one exemplary embodiment.

For a variable attenuator, the series (130) and shunt (140, 150) resistive elements illustrated in the constant impedance attenuator circuit of FIG. 1 are replaced with PIN diodes, which can act as variable resistors. FIG. 2 illustrates an exemplary variable attenuator (200) incorporating PIN diodes as the series (220) and shunt (250, 255) resistive elements. As shown in FIG. 2, a variable attenuator (200) may include both a signal input (205) and a signal output (210). Disposed between the signal input and the signal output is a variable attenuator circuit (200). The variable attenuator circuit (200) includes a series resistive element (220) in the form of a PIN diode coupled in series with a plurality of capacitors (230, 235), one disposed on each end of the series resistive element. A pair of PIN diodes (250, 255) is also coupled in the shunt legs as the shunt resistive elements.

A shunt bias may be provided to the shunt leg PIN diodes (250, 255) through a resistive element (215) as illustrated in FIG. 2. The configuration including the capacitive element (240) illustrated in FIG. 2 allows the PIN diodes in the shunt legs (250, 255) to be coupled in series from a DC bias perspective and in parallel from an RF perspective. The shunt bias provided to the PIN diodes in the shunt legs (250, 255) may be varied. As the shunt bias is increased, the current passing through the PIN diodes (250, 255) is increased causing the impedance of the shunt diodes (250, 255) to be reduced. Conversely, if the shunt bias is decreased, the impedance of the shunt diodes (250, 255) is increased. Similarly, a series bias is provided to the PIN diode acting as the series resistive element (220) through a resistive element (225). Variations of the series bias will affect the impedance of the series PIN diode (220) in a similar manner as mentioned above. Additional elements included in the variable attenuator circuit (200) such as the inductor (245) and the capacitors (230, 235) may be included to remove any residual RF energy from the DC bias lines or signals by filtering and bypassing.

While FIG. 2 illustrates one means for applying and controlling the forward bias currents which flow through each PIN diode (250, 255, 220) in the variable attenuator (200), one skilled in the art will recognize that there are additional configurations that may be used to apply and control the forward bias currents. Additional methods for applying and controlling the forward bias currents include, but are in no way limited to, the use of bias chokes, blocking capacitors, networks of resistors, diodes, op-amps, or appropriate combinations thereof. While various methods for applying and controlling forward bias currents exist, one commonality is that the current in the shunt diodes are equal and the ratio of the shunt and series currents is such that the required impedance is maintained as the attenuation is varied.

However, as noted above, an increase in the attenuation levels often increases the amount of down-tilt experienced by the variable attenuator (200). In general, such attenuator circuits do not maintain a flat or frequency independent response as the attenuation is increased. This is due to inherent parasitic reactances associated with the diode (220, 250, 255) components. This increase in down-tilt makes it difficult to maintain tight tilt specifications during operation.

Figure 3:
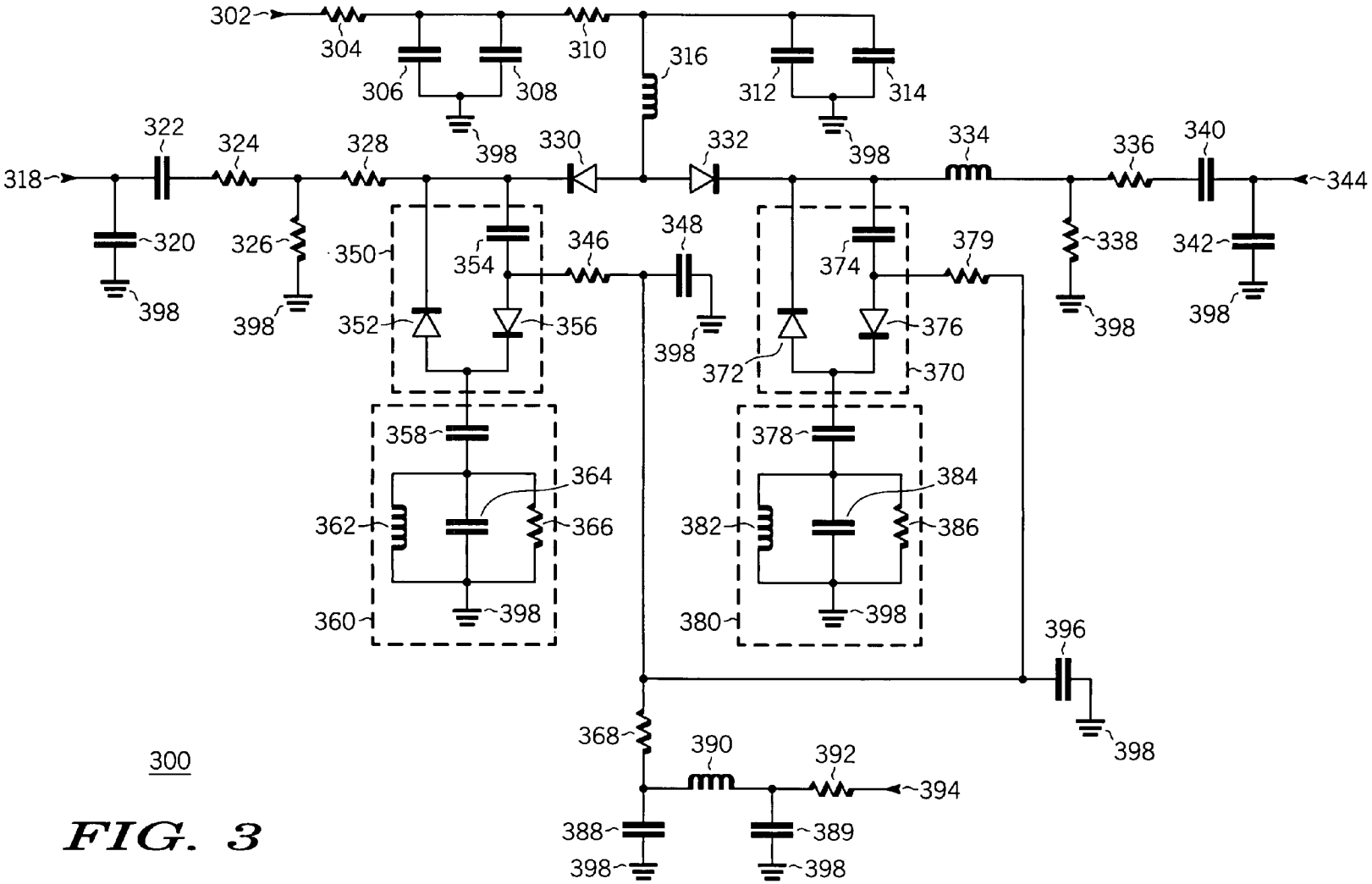
FIG. 3 is a circuit diagram illustrating a 6-diode PIN attenuator including tilt correction according to one exemplary embodiment.

FIG. 3 illustrates an exemplary circuit (300) that functions as an electronically variable RF attenuator (300) with a large attenuation range while maintaining a flat frequency response throughout its attenuation range. As shown in FIG. 3, the exemplary circuit includes a pair of shunt diode circuits (350, 370) and a pair of series diodes (330, 332). Each shunt diode circuit (350, 370) includes a pair of PIN diodes (352, 356, 372, 376) coupled in series. Additionally, each shunt diode circuit (350, 370) includes a capacitive element (354, 374) as illustrated in FIG. 3. The capacitive elements (354, 374) allow the diodes (352, 356, 372, 376) in the shunt circuits to be connected in parallel, from an RF perspective, while being in series from a DC bias perspective. The series diode (330) and series diode (332) together, provide the series leg of the RF attenuator (300) illustrated in FIG. 3.

Also similar to the exemplary circuit illustrated in FIG. 2, the RF attenuator circuit (300) illustrated in FIG. 3 includes an RF input (318) and an RF output (344) coupled to the circuit elements. Disposed between the RF input (318) and the initial components of the shunt diode circuits are a number of components (320, 322, 324, 326, 328) that condition the received RF signal prior to attenuation. Additionally, a number of components (334, 336, 338, 340, 342) condition the RF signal after attenuation prior to the RF output (344).

A series bias input (302) is also illustrated in FIG. 3 electrically coupled to a node disposed between the pair of series diodes (330, 332). A controlled voltage at the series bias input (302) produces the bias current that determines the impedance of the series diodes (330, 332). The current path from the series bias input (302) to the series diodes (330, 332) is through a plurality of resistive elements (304, 310) and an inductive element (316) to reach the series diodes (330, 332). A plurality of capacitive elements (306, 308, 312, 314) coupled to ground (398) as illustrated in FIG. 3 are also coupled to the series bias input (302) to serve as decoupling components used to remove any residual RF energy from the DC bias lines by filtering and bypassing. A DC bias voltage applied to the series bias input (302) produces a current that flows through resistive elements (304, 310) then splits equally between the series diode (330) and resistive element (326) on one hand, and the series diode (332) and resistive element (338) on the other. According to one exemplary embodiment, each diode (330, 332) in the series combination is biased with an equal current whose value is determined by the voltage at the series bias input (302). As the series bias current is increased, the impedance of the series diodes is reduced.

Similar to the series bias input (302), a shunt bias input (394) is also disposed on the RF attenuator circuit (300). The shunt bias input (394) is configured to receive a DC bias voltage applied at shunt bias input (394) that produces a DC current through the resistive elements (368, 392) connected in series. That current then follows a path through resistive element (346), shunt diode (356), shunt diode (352), and resistive element (326) to ground (398). Simultaneously, an equal current flows through resistive element (379), shunt diodes (372, 376), and resistive element (338) to ground (398). Varying the bias voltage applied at the shunt bias input (394) varies the current through the diodes (350, 356, 372, 376) and, therefore, controllably varies their impedance. The remaining components coupled to the shunt bias input (394) such as capacitive element (388), inductive element (390), capacitive element (389), capacitive element (348), and capacitive element (396) are decoupling components used to remove any residual RF energy from the DC bias lines by filtering and bypassing.

In general, if the ratio of the impedance of the above-mentioned elements is correct, constant impedance (75 ohms according to one exemplary embodiment) can be provided, independent of the attenuation value. By controlling the bias current through the diodes, any attenuation value, over a range of 15 dB or more, is possible, with constant impedance. However, as noted above, the ratio of the impedance of the above-mentioned elements is not always correct at all frequencies due to any number of parasitic reactances occurring in the 6-diode PIN attenuator (300) that increase with increased frequency, resulting in down tilt.

According to one exemplary embodiment, a parallel resonant circuit (360, 380) is coupled to the shunt diode circuits (350, 370) as illustrated in FIG. 3 to cancel the effect of parasitic reactances elsewhere in the attenuator circuit (300). According to one exemplary embodiment shown in FIG. 3, each parallel resonant circuit (360, 380) includes a plurality of capacitive components (358, 364, 378, 384), an inductive component (362, 382), and a resistive component (366, 386) coupled to the shunt diode circuits (350, 370) and ground (398) as shown in FIG. 3. These parallel resonant circuits (360, 380) including the inductive components (362, 382) and the capacitive components (364, 384) coupled in parallel have a wide resonance bandwidth and are resonant at a frequency that is slightly higher than the highest signal frequency. As a result, these circuits exhibit high impedance at the highest signal frequencies and progressively lower impedance as frequency decreases. The parallel resistive elements (366, 386) are included to limit the maximum impedance. From an RF signal point of view, the parallel resonant circuits (360, 380) are coupled in series with the shunt legs of the attenuator.

Exemplary Implementation and Operation

During operation of the RF attenuator circuit (300) illustrated in FIG. 3, a controlled bias current at the series bias input (302) is provided to produce the bias current that determines the impedance of the series diodes (330, 332) through the current path illustrated above. Additionally, a controlled bias current is provided to the shunt bias input (394) to control the impedance of the shunt diodes (352, 356, 372, 376) through the current path illustrated above.

One of ordinary skill in the art will note that the diode pairs (352, 356, 372, 376) are coupled in series for the DC bias (incurring equal currents in both), but in parallel for RF signals received by the circuit. This configuration produces a minimum impedance that is approximately 50% of that of a single diode, and makes very large attenuation ranges possible. By applying appropriate voltage values at the shunt bias input (394) and the series bias input (302), the attenuator circuit can be caused to produce any specific attenuation value while maintaining the correct impedance match. A low attenuation value results from a high bias current through the series diodes (330, 332) and a low bias current through the shunt diodes (352, 356, 372, 376). Conversely, a high attenuation value results when the series diode bias current is low and the shunt diode bias current is high. In practice, the bias voltages required for any given attenuation value are determined experimentally and stored in a digital lookup table (not shown). A microprocessor-based embedded intelligence section (not shown) of the apparatus incorporating the present RF attenuator circuit (300) may then look up a number of bias values and regenerates them via digital-to-analog conversion.

As the impedance of the shunt diodes (352, 356, 372, 376) becomes lower, the effect of the parallel resonant circuits (360, 380) increases, just as the undesirable tilt increases. As the impedance of the shunt diodes (352, 356, 372, 376) decreases the resonant circuits (360, 380), consequently, represent an increasing percentage of the total shunt impedance. Since the resonant impedance increases with frequency, the attenuation decreases with frequency, the magnitude of the effect being proportional to actual attenuation. This effect tends to cancel the effect of parasitic reactances elsewhere in the RF attenuator circuit (300), which tends to increase attenuation with frequency, producing an attenuation that does not vary with frequency, regardless of attenuation setting. By incorporating proper component values in the parallel resonant circuits (360, 380), the "tilt" effect will be accurately compensated and a "flat" loss versus frequency response will result at all loss settings.

Figure 4:
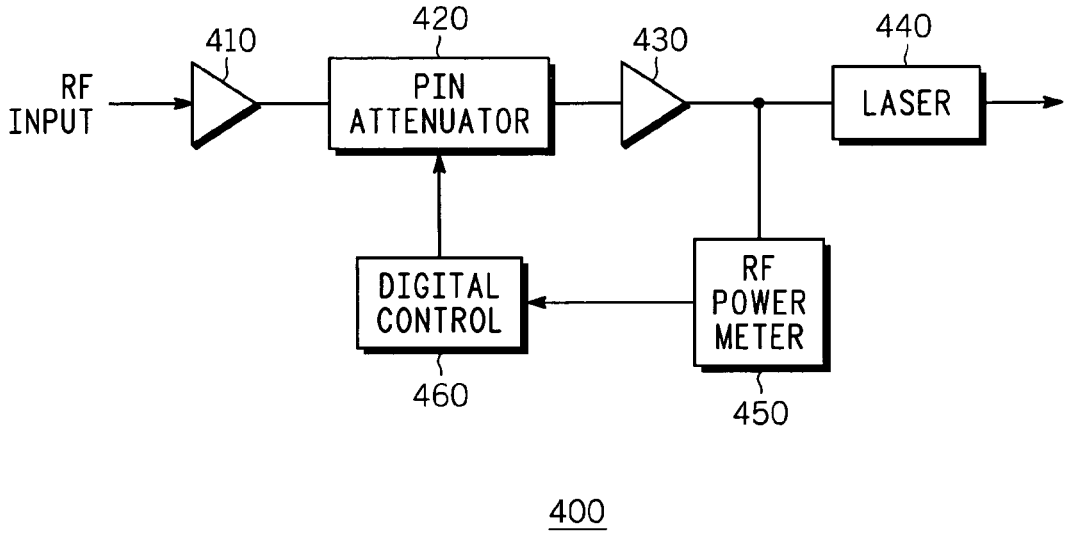
FIG. 4 is a simple block diagram illustrating an exemplary use of a 6-diode PIN attenuator including tilt correction according to one exemplary embodiment.

According to one exemplary embodiment illustrated in FIG. 4, the present RF attenuator circuit (300; FIG. 3) forms a part of an optical transmitter product such as a laser transmitter. As shown in FIG. 4, the laser transmitter module (400) has a basic function of accepting a broadband RF input signal and optically modulating the output of a laser (440) using the input signal. The laser's output is then coupled into an optical fiber (not shown) for transmission to a remote location. Within the laser transmitter module (400), the RF signal is first buffered, or amplified (410), then applied to the present attenuator circuit (420). Once the signal is attenuated by the present attenuator circuit (420), the attenuated RF signal is again amplified by an amplifier (430) and is then applied to an input of a laser (440). The RF signal level at the laser (440) is measured by an RF power meter (450) or other metering device and compared to a predetermined value stored in a digital control (460) having imbedded intelligence/firmware. Upon comparison, the digital control (460) produces an error value that is then used to adjust the loss of the attenuator circuit (420) such that the RF level at the laser (440) input is maintained at an optimum value. Consequently, the overall effect is that despite large variations in the module's RF input level and fluctuations of gain or loss elsewhere in the RF signal path with time or temperature the laser RF input level remains optimized.

The bias voltages are provided to the attenuator circuit (420) by a firmware based digital control system (460). This embedded logic system measures the RF level of the signal applied to the laser (440) and uses the attenuator (420) to maintain precise control of the laser's operating point, despite variations in the product's input signal level or internal gain. The incorporation of the present parallel resonant circuits (360, 380; FIG. 3) increases the precision with which the laser's operating point may be controlled because the attenuator (420) is no longer plagued by unwanted tilt effects.

While the above exemplary embodiment illustrates one possible 6-diode PIN attenuator configuration incorporating a tilt correction circuit, the present system and method are in no way limited to the exemplary configuration illustrated herein. Rather, the present system and method may be incorporated into any number of attenuator configurations including any number of component combinations by coupling the exemplary parallel resonant circuits (360, 380) to the shunt diodes to eliminate the effect of parasitic reactances elsewhere in the attenuator circuit.

In conclusion, the present system and method illustrate a 6-diode PIN attenuator with tilt correction. More specifically, the present system includes the coupling of a parallel resonant circuit to each shunt leg of an attenuator. By coupling the parallel resonant circuit to the shunt legs of the 6-diode PIN attenuator, the undesirable tilt may be effectively reduced. As the impedance of the shunt diodes of the 6-diode PIN attenuator decrease, the resonant circuits will represent an increasing percentage of the total shunt impedance. Since the resonant impedance increases with frequency, the attenuation decreases with frequency, with the magnitude of the effect being proportional to actual attenuation. This effect tends to cancel the effect of parasitic reactances elsewhere in the RF attenuator circuit, which tends to increase attenuation with frequency, producing an attenuation that does not vary with frequency, regardless of attenuation settings. This reduction in attenuation variation due to changes in frequency allows the maintenance of tight tilt specifications in equipment incorporating the present attenuator.

The preceding description has been presented only to illustrate and describe the present method and system. It is not intended to be exhaustive or to limit the present system and method to any precise form disclosed. Many modifications and variations are possible in light of the above teaching.

The foregoing embodiments were chosen and described in order to illustrate principles of the system and method as well as some practical applications. The preceding description enables others skilled in the art to utilize the system and method in various embodiments and with various modifications as are suited to the particular use contemplated. It is intended that the scope of the system and method be defined by the following claims.

What is claimed is:

1. An RF attenuator comprising:

an RF signal input;

an RF signal output;

a first and a second series diode coupled in series with said RF signal input and said RF signal output;

a first shunt branch electrically coupled to said RF attenuator between said RF signal input and said first and second series diodes, said first shunt branch including a plurality of shunt diodes;

a second shunt branch electrically coupled to said RF attenuator between said RF signal output and said first and second series diodes, said second shunt branch including a plurality of shunt diodes; and a first parallel resonant circuit electrically coupled in series to said first shunt branch and a second parallel resonant circuit electrically coupled in series to said second shunt branch.

2. The RF attenuator of claim 1, wherein said first and second series diodes and said plurality of shunt diodes comprise positive-intrinsic-negative (PIN) diodes.

3. The RF attenuator of claim 2, further comprising:

a shunt bias input electrically coupled to said first and second shunt branch, wherein said shunt bias input is configured to route a first direct current (DC) bias current to said plurality of shunt diodes; and a series bias input electrically coupled to said first and second series diodes, wherein said series bias input is configured to route a second DC bias to said first and second series diodes;

wherein said first and said second DC bias are configured to establish an impedance of said plurality of shunt diodes and said first and second series diodes.

4. The RF attenuator of claim 3, wherein said first and second parallel resonant circuits are resonant at a frequency higher than a highest signal frequency received by said RF attenuator.

5. The RF attenuator of claim 3, wherein an impedance of said first and second parallel resonant circuits increases with an increase of a received RF signal frequency.

6. The RF attenuator of claim 3, wherein said first and second parallel resonant circuits are coupled in series with said first and second shunt branch from a received RF signal perspective.

7. The RF attenuator of claim 3, wherein said first and said second parallel resonant circuits each comprise an inductor, and a capacitor electrically coupled in parallel.

8. The system of claim 7, wherein said first and said second parallel resonant circuits each further comprise a resistor electrically coupled in parallel with said inductor and said capacitor, wherein said resistor is configured to limit a maximum impedance of each of said parallel resonant circuits.

9. A system for reducing tilt effects in a radio frequency (RF) attenuator comprising:

an RF attenuator including at least one series diode, and at least one shunt branch having at least one shunt diode, said shunt branch being electrically coupled to said series diode;

a parallel resonant circuit electrically coupled to each of said at least one shunt branch, wherein said parallel resonant circuit is configured to compensate for a parasitic reactance in said RF attenuator;

a shunt bias input electrically coupled to said at least one shunt branch, wherein said shunt bias input is configured to route a first direct current (DC) bias current to said at least one shunt diode; and a series bias input electrically coupled to said at least one series diode, wherein said series bias input is configured to route a second DC bias to said at least one series diode;

wherein said first and said second DC bias are configured to establish an impedance of said at least one shunt diode and said at least one series diode, said at least one series diode and said at least one shunt diode comprise positive-intrinsic-negative (PIN) diodes, and said parallel resonant circuit is coupled in series with said at least one shunt branch from a received RF signal perspective.

10. The system of claim 9, wherein said parallel resonant circuit is resonant at a frequency higher than a highest signal frequency received by said RF attenuator.

11. The system of claim 9, wherein an impedance of said parallel resonant circuit increases with an increase of a received RF signal frequency.

12. A signal transmitter comprising:

an RF input;

a PIN attenuator with tilt correction; and a signal output;

wherein said PIN attenuator includes an RF signal input, an RF signal output, a first and a second series diode coupled in series with said RF signal input and said RF signal output, a first shunt branch electrically coupled to said RF attenuator between said RF signal input and said first and second series diodes, said first shunt branch including a plurality of shunt diodes, a second shunt branch electrically coupled to said RF attenuator between said RF signal output and said first and second series diodes, said second shunt branch including a plurality of shunt diodes, and a first parallel resonant circuit electrically coupled in series to said first shunt branch and a second parallel resonant circuit electrically coupled in series to said second shunt branch.

13. The signal transmitter of claim 12, wherein:

said RF signal input is communicatively coupled to said signal output;

said signal output comprising a signal modulation device.

14. The signal transmitter of claim 13, wherein said signal modulation device comprises a laser, said laser being configured to optically modulate a received RF signal into an optical output.

15. A system for reducing tilt effects in a radio frequency (RF) attenuator comprising:

an RF attenuator including at least one series diode, and at least one shunt branch having at least one shunt diode, said shunt branch being electrically coupled to said series diode;

a parallel resonant circuit electrically coupled to each of said at least one shunt branch, wherein said parallel resonant circuit is configured to compensate for a parasitic reactance in said RF attenuator;

a shunt bias input electrically coupled to said at least one shunt branch, wherein said shunt bias input is configured to route a first direct current (DC) bias current to said at least one shunt diode; and a series bias input electrically coupled to said at least one series diode, wherein said series bias input is configured to route a second DC bias to said at least one series diode;

wherein said first and said second DC bias are configured to establish an impedance of said at least one shunt diode and said at least one series diode, said at least one series diode and said at least one shunt diode comprise positive-intrinsic-negative (PIN) diodes, said parallel resonant circuit comprises an inductor, and a capacitor electrically coupled in parallel, and said parallel resonant circuit further comprises a resistor electrically coupled in parallel with said inductor and said capacitor, wherein said resistor is configured to limit a maximum impedance of said parallel resonant circuit.

16. The system of claim 15, wherein said parallel resonant circuit is resonant at a frequency higher than a highest signal frequency received by said RF attenuator.

17. The system of claim 15, wherein an impedance of said parallel resonant circuit increases with an increase of a received RF signal frequency.

18. The system of claim 15, wherein said RF attenuator further comprises:

an RF signal input;

an RF signal output;

a first and a second series diode coupled in series with said RF signal input and said RF signal output;

a first shunt branch electrically coupled to said RF attenuator between said RF signal input and said first and second series diodes, said first shunt branch including a plurality of said PIN diodes;

a second shunt branch electrically coupled to said RF attenuator between said RF signal output and said first and second series diodes, said second shunt branch including a plurality of said PIN diodes; and a first parallel resonant circuit electrically coupled in series to said first shunt branch and a second parallel resonant circuit electrically coupled in series to said second shunt branch.

19. The system of claim 18, further comprising a decoupling component electrically coupled to said series bias input, wherein said decoupling component is configured to remove a residual RF energy from the said series bias input.

20. The system of claim 19, further comprising a decoupling component electrically coupled to said shunt bias input, wherein said decoupling component is configured to remove a residual RF energy from said shunt bias input.

* * * * *